United States Patent [19]

Ohshita

[11] Patent Number: 4,976,560

[45] Date of Patent: Dec. 11, 1990

[54] MECHANICAL PENCIL WITH A PLASTIC CHUCK

[75] Inventor: Katsuji Ohshita, Kure, Japan

[73] Assignee: The Sailor Pen Co., Ltd., Tokyo, Japan

[21] Appl. No.: 192,129

[22] Filed: May 10, 1988

[30] Foreign Application Priority Data

Nov. 26, 1987 [JP] Japan ..... 62-178930[U]

[51] Int. Cl.[5] ..... B43K 21/22

[52] U.S. Cl. ..... 401/65; 401/87; 401/94

[58] Field of Search ..... 401/67, 94, 65, 87

[56] References Cited

U.S. PATENT DOCUMENTS

| | | | |
|---|---|---|---|
| 2,473,149 | 6/1949 | Juelss | 401/65 |
| 2,823,644 | 2/1958 | Den Bussche et al. | 401/87 X |
| 2,845,898 | 8/1958 | Stanek | 401/94 |
| 3,001,510 | 9/1961 | Chelazzi | 401/94 |
| 3,998,558 | 12/1976 | Katz | 401/94 |
| 4,106,874 | 8/1978 | Torii | 401/67 |
| 4,140,408 | 2/1979 | Mizutani | 401/87 X |
| 4,230,413 | 10/1980 | Gartner | 401/94 X |
| 4,490,061 | 12/1984 | Katz | 401/94 X |
| 4,619,539 | 10/1986 | Kageyama | 401/65 X |

FOREIGN PATENT DOCUMENTS

| | | | |
|---|---|---|---|
| 680248 | 8/1939 | Fed. Rep. of Germany | 401/65 |
| 1103083 | 10/1955 | France | 401/94 |
| 352592 | 4/1961 | Switzerland | 401/94 |
| 373458 | 5/1932 | United Kingdom | 401/94 |

*Primary Examiner*—Steven A. Bratlie

*Attorney, Agent, or Firm*—Burns, Doane, Swecker & Mathis

[57] ABSTRACT

A mechanical pencil with a chuck made of plastics includes a lead case connected with the chuck, a ring arranged to surround and hold the chuck, and a spring for biasing the chuck toward a position where it is engaged with the ring, all of which are disposed within a tubular housing. The plastic chuck includes a cylindrical tube connected with the lead case and three elastically deformable extensions integral therewith. Each of these extensions has an engaging portion for grasping a lead and a connecting portion whose inner surface axially forms a curve of secondary degree extending from the cylindrical tube and expanding radially toward the engaging portion in its free state, so that the engaging portion aligns with the lead when it is engaged with the ring. Accordingly, a grasping force is uniformly applied around the lead.

1 Claim, 1 Drawing Sheet

MECHANICAL PENCIL WITH A PLASTIC CHUCK

BACKGROUND OF THE INVENTION

1. Field of the Invention

The present invention relates to a mechanical pencil with a chuck which permits a lead to advance but prevents the lead from retracting, and more particularly to a mechanical pencil with a chuck made of plastics.

2. Description of the Prior Art

One such mechanical pencil with a chuck U.S. Pat. No. 4,627,756, discloses a known mechanical pencil having a chuck whose mechanism is described in detail, but whose material is not described. In general, the chuck is made of metal or plastics. The chuck made of plastics, e.g. synthetic resin, has the advantage of being less expensive to manufacture, compared with a metal chuck which is generally manufactured from a shaft or pipe made of metal such as brass, and the plastic chuck does not damage it is grasping, nor destroy it when an excessive writing force is applied thereto.

The known plastic chuck is formed like a tubular member axially divided into two pieces from its tip end portion toward its rear end portion, the divided pieces flaring away from each other radially. The tip end portions of the divided pieces are for grasping a lead with their inner surfaces, are engaged at their outer surfaces with a chuck ring which is axially slidably positioned around the tubular member. The tip end portions are forced by the chuck ring toward the center or the axis of the tubular member, so that the lead is grasped and held therein.

In a mechanical pencil with the above-described plastic chuck, however, the lead grasping force is sometimes insufficient to hold the lead, so that the lead may be retracted into a tip member or a lead guide tube of the mechanical pencil when a large writing force is applied to the lead.

Further, in the known plastic chuck having two divided pieces, the tip end portions are formed into a cylindrical tube of an oval cross-section when the tubular member is engaged with the chuck ring, so as to focus the lead grasping force on the axis of the lead. In that chuck, a contacting area between the outer surface of the chuck and the inner surface of the chuck ring to be mounted thereon is small due to a difference in a radius of curvature therebetween. Accordingly, the outer surface of the tip end portion of the chuck is likely to be partially worn and consequently formed thereon is a stepped portion which prevents the chuck ring from moving toward the tip end portion, so that the lead grasping force is reduced and a durability of the chuck is affected adversely.

SUMMARY OF THE INVENTION

It is, therefore, an object of the present invention to provide a mechanical pencil with a chuck made of plastics which maintains a sufficient grasping force on a lead and thereby effectively holds the lead.

It is another object of the present invention to provide a mechanical pencil with a plastic chuck which produces a large grasping force uniformly applied around the lead.

It is further object of the present invention to provide a durable plastic chuck for a mechanical pencil by which a grasping force is applied uniformly around the lead without causing the tip end portion of the chuck to be partially worn.

In accomplishing these and other objects, a mechanical pencil with a plastic chuck according to the present invention comprises a tubular housing, a lead case axially movably mounted within the tubular housing for storing leads therein, a chuck made of plastics axially movably mounted within the tubular housing and connected with the lead case, a ring member which is disposed within the tubular housing and arranged to hold the chuck, and spring means disposed within the tubular housing for biasing the chuck toward a position where it is tightly engaged with the ring member.

In the above arrangement, the plastic chuck includes a substantially cylindrical tube connected with the lead case for introducing a lead therefrom, and three elastically deformable extensions integral with and axially extending from the cylindrical tube in peripherally spaced relationship with one another for holding the lead. Each of the extensions has at its forward end portion an engaging portion for grasping the lead by its inner surface, and a connecting portion for connecting the engaging portion with the cylindrical tube. An inner surface of the connecting portion extends axially to form a curve of substantially secondary degree extending from the cylindrical tube and expanding radially toward the engaging portion when the connecting portion is in its free state. The ring member is, therefore, arranged to hold the chuck loosely when it is positioned around the connecting portion, and hold the chuck tightly so as to form a cylindrical outer surface when it is positioned around the engaging portion. The spring means biases the chuck toward a position where the ring member is positioned around the engaging portion.

The engaging portion of each of the elastically deformable extensions is preferably formed with a protrusion on an outer surface thereof extending from the forward end thereof to the rearward end thereof so as to form the cylindrical outer surface when the extensions are united theretogether, with the ring member positioned around the engaging portion.

A radius of curvature of an outer surface of the protrusion preferably conforms to a radius of curvature of an inner surface of the ring member.

A radius of curvature of the inner surface of the engaging portion may be smaller than a radius of the lead to be engaged therewith.

BRIEF DESCRIPTION OF THE DRAWINGS

The above stated objects and following description will become readily apparent with reference to the accompanying drawings, in which.

DESCRIPTION OF THE PREFERRED EMBODIMENT

Figure 1:
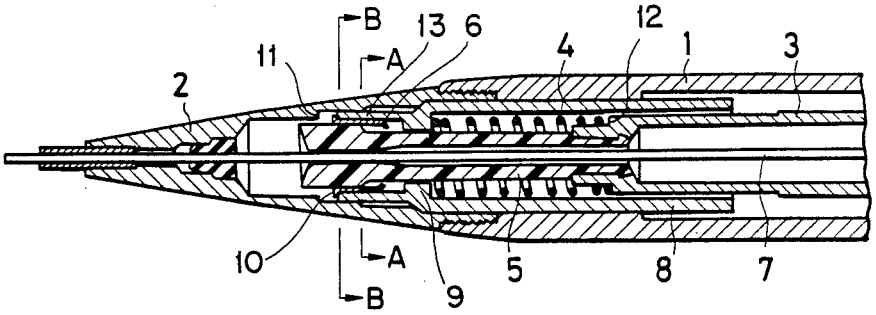
FIG. 1 is a fragmentary longitudinal sectional view of a mechanical pencil according to a preferred embodiment of the present invention.

Referring to FIG. 1, there is illustrated a mechanical pencil, a rear end portion of which is omitted as is apparent from a conventional mechanical pencil, and which comprises a barrel 1 and a tip member 2 connected therewith, or threaded thereinto to form a tubular housing theretogether. Within this tubular housing is disposed a sleeve 8 extending from the barrel 1 to the tip member 2. The sleeve 8 has a cylindrical body, on an inner surface of which a radially inward projection 9 is formed.

In the sleeve 8, a lead case 3 and a chuck 5 are axially movably disposed. The lead case 3 is tubular and has a forward open end portion to which the chuck 5 is secured. The lead case 3 is fed with a plurality of leads, or lead sticks including a lead 7 from its rearward open end portion and stores the same therein.

On a forward open end portion 13 of the sleeve 8, mounted is a chuck ring (hereinafter referred to as a ring) 6 having a flange portion 10 at its forward end and surrounding the chuck 5. The flange portion 10 of the ring 6 lies on the forward end of the sleeve 8, or abuts on a radially inwardly projecting stepped 11 portion formed in the tip member 2 to be held against axial displacement.

Between the inward projection 9 of the sleeve 8 and a shoulder portion 12 formed at the forward end portion of the lead case 3, a compression coil spring 4 is mounted for biasing the lead case 3 away from the inward projection 9 of the sleeve 8. The chuck 5 is inserted into the forward end portion 13 of the sleeve 8 with the ring 6 mounted thereon, and secured to the forward end portion of the lead case 3 within the sleeve 8. When the lead case 3, spring 4, chuck 5, ring 6 and sleeve 8 are assembled within the barrel 1 and the tip member 2, the forward end of the chuck 5 is spaced axially apart from an inner end wall of the tip member 2 at a predetermined distance with the chuck 5 engaged witn the ring 6.

Figure 2:
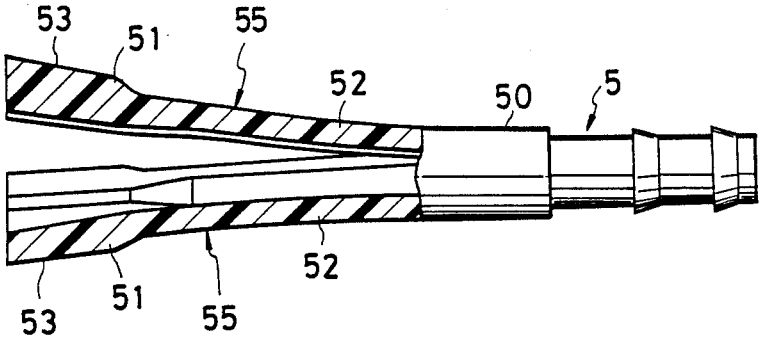
FIG. 2 is a side view, partially in section, of a plastic chuck according to a preferred embodiment of the present invention.
Figure 3:
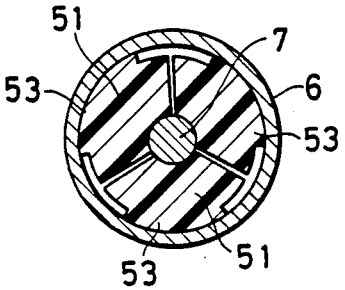
FIG. 3 is a cross-sectional view about section line A—A of FIG. 1 showing the plastic chuck grasping a lead with a chuck ring held tightly around the chuck.

The chuck 5 is formed by an injection molding with plastics of large rigidity, such as polyacetal with 15% glass fiber. Referring particularly to FIG. 2, the chuck 5 comprises a substantially cylindrical tube 50 and three elastically deformable extensions (hereinafter referred to as extensions) 55 integral with and axially extending from the cylindrical tube 50 in peripherally spaced relationship with one another. Namely, the chuck 5 is axially divided from its forward end to its central portion into three pieces, i.e. three extensions 55 which are peripherally equally divided at an angle of 120° as shown in FIG. 3.

The extensions 55 are formed to expand radially from the cylindrical tube 50 toward their forward ends in their free states, i.e. without engaging with the ring 6. Each of the extensions 55 has at its forward end an engaging portion 51 which engages with and grasps the lead 7 to be held therein, and a connecting portion 52 which connects the engaging portion 51 with the cylindrical tube 50. The connecting portion 52 of each of the extensions 55 does not extend axially at a constant gradient, but extends axially so as to form at its inner surface a curve of secondary degree in which an amount of radial offset from the axis of the chuck 5 increases in accordance with an axial distance from the cylindrical tube 50. In this respect, the connecting portion 52 may not necessarily form a curve of secondary degree, but may form a series of straight lines which conform to, or similar to the curve of secondary degree.

The circumferential length of each of the extensions 55 is smaller than that of the extensions of the known chuck having only two divided pieces. However, since the chuck 5 is made of rigid plastics as described above, it is sufficiently rigid, and therefore the radial elastic force which forces the chuck 5 from the ring 6 during the chuck's forward movement. Further, the chuck 5 is rigid enough to be pressed into the lead case 3, so that it can be assembled in an automatic assembly line.

Figure 4:
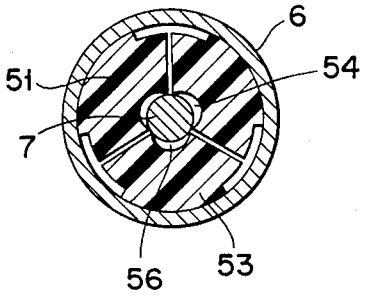
FIG. 4 is a cross sectional view about section line B—B of FIG. 1 showing the plastic chuck and the chuck ring as they first contact each other.

As seen in FIG. 4, a radius of curvature of the inner surface of the engaging portion 51 is slightly smaller than a radius of the lead to be engaged therewith, so that a small clearance 54 is made between a peripherally central portion 56 of the engaging portion 51 and the lead 7 when they contact each other. On the outer surface of the engaging portion 51 is formed a protrusion 53 which extends axially from the forward end of the engaging portion 51 to the rearward end thereof as shown in FIG. 2, with a predetermined width or peripheral length in the center of the periphery of the engaging portion 51 as shown in FIG. 3. A radius of curvature of the outer surface of the protrusion 53 is same as that of the inner surface of the ring 6, so that the ring 6 contacts the whole outer surface of the protrusion 53 uniformly when the ring 6 engages with the protrusion 53. Accordingly, the contacting area between the outer surface of the protrusion 53 and the inner surface of the ring 6 is made much larger than the known chuck having two divided pieces.

In operation, when an end cap (not shown) coupled with the lead case 3 is depressed against the biasing force of the spring 4, the lead case 3 is moved axially toward the tip member 2 until the forward end of the chuck 5 contacts the inner end wall of the tip member 2 to advance the lead 7 through the tip member 2. During this movement of the chuck 5, the ring 6 moves in the same direction, but the ring 6 is prevented from moving further when the flange portion of the ring 6 contacts the stepped portion of the tip member 2, so that the chuck 5 is disengaged from the ring 6 and the lead 7 is released from the grasping force of the chuck 5.

When the depressing force to the lead case 3 is released, the lead case 3 and the chuck 5 are moved axially rearward, or away from the tip member 2, so that the chuck 5 engages with the ring 6 and applies a rearward axial thrust to the ring 6. Accordingly, the ring 6 moves rearward until the flange of the ring 6 contacts the forward end of the sleeve 8.

Further rearward movement of the chuck 5 applies the grasping force to the lead held therein. In this movement of the chuck 5, the engaging portion 51 aligns with the lead 7, namely the inner surface of the engaging portion 51 is positioned in parallel with the axis of the chuck 5, since the connecting portion 52 extends axially so as to form in its free state a curve of secondary degree expanding radially toward its forward end. Consequently, the lead is grasped by the whole inner surface of the engaging portion 51. In this respect, if the connecting portion extends axially to form a straight line as in the known mechanical pencil, the inner surface of the engaging portion is not positioned in parallel with the axis of the chuck and part of the inner surface of the engaging portion contacts and grasps the lead when the engaging portion is engaged with the ring, so that the lead grasping force is much smaller in comparison with the present embodiment.

When the ring 6 is engaged with the protrusion 53, which is formed on the outer surface of the engaging portion 51, by further rearward movement of the chuck 5, the ring 6 contacts the peripherally central portion of the engaging portion 51 and the lead grasping force is applied strongly to a peripherally central portion 56 of the inner surface of the engaging portion 51. Since the radius of curvature of the inner surface of the engaging portion 51 is slightly smaller than the radius of the lead 7 and there exists a small clearance 54 between the lead 7 and the peripherally central portion 56 of the inner surface of the engaging portion 51, (as shown in FIG. 4) and since the protrusion 53 extends over a smaller circumferential arc than the engaging portion 51, the engaging portion 51 is elastically deformed outwardly to contact the lead 7 uniformly as shown in FIG. 3 experiences a lead 7 therefore grasping force on its outer surface in the three radially inward and peripherally equally spaced directions. Namely, the lead grasping force is increased since the lead 7 is grasped in the three inward directions in such a condition that the inner surface of the engaging portion 51 is parallel to the lead 7 and that the axis of the lead 7 is exactly same as the axis of the chuck 5. Consequently, the lead 7 is grasped strongly and firmly.

Further, since the contacting area between the ring 6 and the protrusion 53 is large, this area is hardly worn, during use so that the engaging portion 51 always engages with the ring 6 at the exact desired position. Accordingly, sufficient lead grasping force is maintained in the chuck 5.

It should be apparent to one skilled in the art that the above-described embodiment is merely illustrative of but a few of the many possible specific embodiments of the present invention. Numerous and various other arrangements can be readily devised by those skilled in the art without departing from the spirit and scope of the invention as defined in the following claims.

What is claimed is:

1. A chuck and ring member for a mechanical pencil, comprising:

a chuck including a substantially cylindrical tube for introducing a lead therethrough, and a plurality of elastically deformable extensions integral with and axially extending from said cylindrical tube in peripherally spaced relationship with one another for holding said lead, each of said extensions having at a forward end portion thereof an engaging portion for grasping said lead by an inner surface thereof, and a connecting portion for connecting said engaging portion with said cylindrical tube, each of said engaging portions including a protrusion on a radially outward surface thereof;

a ring member arranged around said chuck so as to hold said chuck loosely in a first position and so as to hold said chuck tightly in a second position in which an inner surface of said ring member tightly conforms to the outer surfaces of said protrusions;

wherein a radius of curvature of said inner surface of each of said engaging portions is smaller than a radius of said lead, and each of said protrusions extends over a smaller circumferential arc than each of said engaging portions;

whereby a small clearance is formed between said lead and a peripherally central portion of each of said engaging portion inner surfaces when said lead and said engaging portions contact each other in said first position, and a portion of each of said engaging portion inner surfaces deforms outwardly when said ring member tightly conforms to the outer surfaces of said protrusions so that said engaging portion inner surfaces tightly conform to the outer surface of said lead in said second position.

* * * * *